United States Patent [19]

Kotuby et al.

[11] 4,233,995

[45] Nov. 18, 1980

[54] CIGARETTE/CIGAR TREATMENT DEVICE

[75] Inventors: Paul M. Kotuby, Naugatuck; Joseph F. Reed, Bridgewater, both of Conn.

[73] Assignee: Risdon Corporation, Naugatuck, Conn.

[21] Appl. No.: 29,191

[22] Filed: Apr. 12, 1979

[51] Int. Cl.[3] ..... A24F 47/00

[52] U.S. Cl. ..... 131/133 R; 131/144; 131/170 R

[58] Field of Search ..... 131/170 R, 144, 261 A, 131/133, 140 R; 222/162

[56] References Cited

U.S. PATENT DOCUMENTS

| | | | |
|---|---|---|---|
| 2,333,049 | 10/1943 | Shapiro | 131/133 R |
| 3,302,834 | 2/1967 | Alsop | 222/162 |
| 3,319,632 | 5/1967 | Burbig | 131/133 R |
| 3,636,959 | 1/1972 | Marand | 131/133 A |
| 3,677,269 | 7/1972 | Hudson | 131/134 |
| 3,732,872 | 5/1973 | Lakritz | 131/133 R |
| 3,847,162 | 11/1974 | Seil | 131/133 R |
| 3,853,039 | 12/1974 | Haslam et al. | 131/133 R X |
| 4,150,677 | 4/1979 | Osbourne, Jr. et al. | 131/144 |

*Primary Examiner*—Stephen C. Pellegrino

*Attorney, Agent, or Firm*—St.Onge, Steward, Johnston, Reens & Noë

[57] ABSTRACT

A device for use by a smoker to introduce treatment fluids into a cigar, cigarette, charge of pipe tobacco and similar consumer units of smoking tobacco.

3 Claims, 8 Drawing Figures

CIGARETTE/CIGAR TREATMENT DEVICE

BACKGROUND OF THE INVENTION

1. Field of the Invention

This invention is directed to dispensing devices generally, and more particularly to devices adapted for personal use by a smoker to introduce a quantity of treatment fluid into a cigarette, cigar or a charge of pipe tobacco to modify the character of the combustion products produced by smoking. Devices of the invention disclosed herein are characterized by their convenience and effectiveness in use by the smoker, as well as their simplicity and economy of manufacture.

2. Description of the Prior Art

Tobacco treatment devices intended for consumer use have frequently been proposed, an example of one such device pertinent to this invention being illustrated and described in U.S. Pat. No. 3,677,269. According to that patent, the device contains a compartment within which a cigarette is placed by the smoker, after which a bellows element of the device is operated to induce a pressure differential between opposite ends of the cigarette, and a charge of treatment fluid is sumultaneously introduced and caused to be drawn into and to permeate the tobacco. That prior device has a relatively complicated mechanical design and is difficult to mass produce economically; moreover it lacks complete suitability for average consumer use.

Many other devices ranging from rather elemental types such as those illustrated in U.S. Pat. Nos. 2,333,049 and 3,319,632, to more complex arrangements such as those illustrated in U.S. Pat. Nos. 3,636,959, 3,732,872 and 3,847,162, are representative of prior known devices thought to be most pertinent to the invention disclosed here. The disadvantage of those prior devices in terms of convenience and sevicability for average consumer use, manufacturing economy as well as user economy, are believed to be responsible in good measure for the relatively low degree of acceptance such devices have received in the trade.

It is accordingly a principal objective of this invention to provide a device for treatment of smoking tobacco in consumer unit form; i.e., as a cigarette, cigar or charge of pipe tobacco, in order to modify the combustion products of the tobacco and render it more acceptable to the smoker.

The invention is illutrated by the devices shown in the accompanying drawings in which FIG. 1 is a perspective view showing one form of the assembled treatment device;

DETAILED DESCRIPTION OF THE PREFERRED EMBODIMENT

Figure 1:
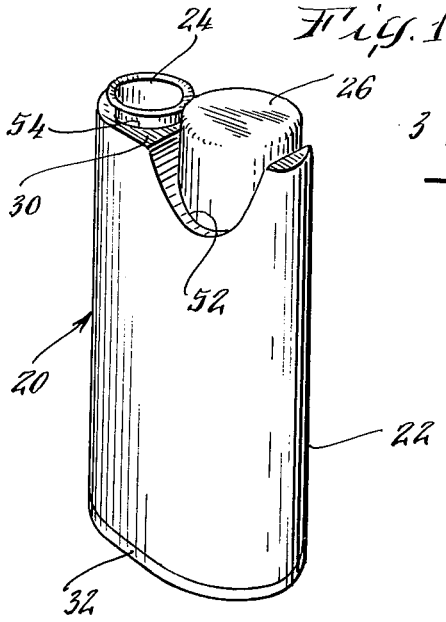
Figure 2:
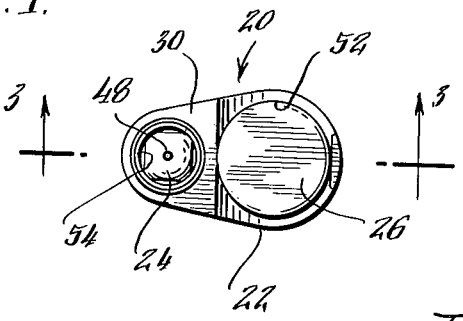
FIG. 2 is a top plan view of the device of FIG. 1.

The treatment device 20 seen in FIGS. 1 and 2 comprises a hand-held unit which conveniently may be approximately the same size as a conventional cigarette lighter. The device here illustrated is adapted more specifically for treatment of individual cigarettes, and comprises an outer casing 22 supporting an upwardly open cigarette receiver 24 and a conventional valved aerosol dispenser in side-by-side arrangement. The aerosol dispenser is in inverted position in casing 22 so that only the closed bottom end of dispenser 26 is exposed. The user inserts a cigarette into the exposed end of receiver 24, usually immediately prior to smoking the cigarette, and depresses the exposed end of aerosol dispenser 26. This releases a charge of treatment fluid which is injected into the cigarette, as will be further explained below.

Figure 3:
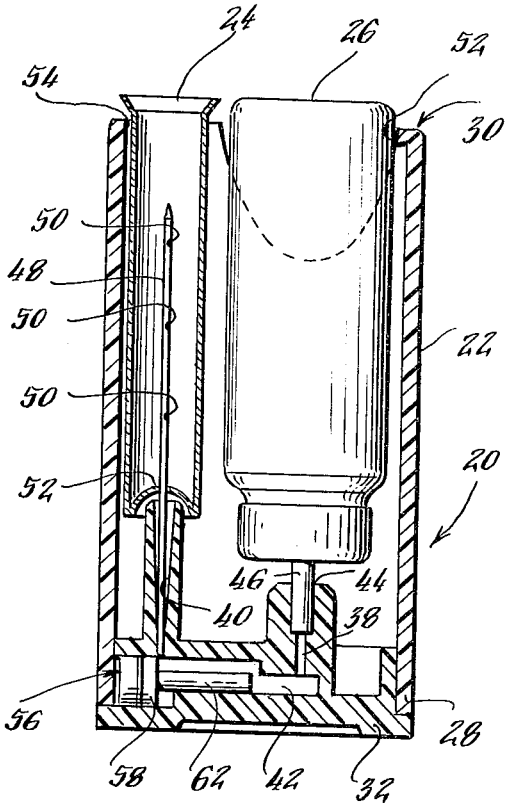
FIG. 3 is a sectional view taken on line 3—3 of FIG. 2.
Figure 6:
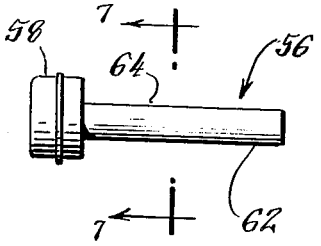
FIG. 6 is a side view of a restrictor plug removably receivable in the base element.
Figure 7:
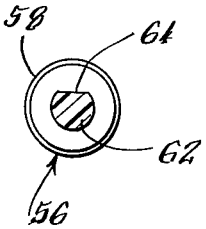
FIG. 7 is a sectional view on line 7—7 of FIG. 6.
Figure 5:
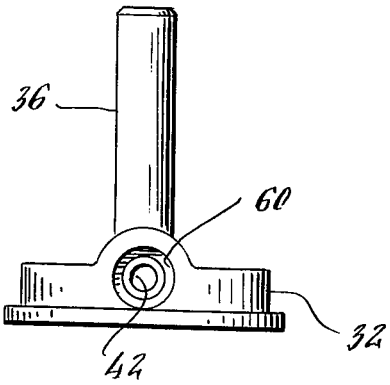
FIG. 5 is an end elevational view of the base element.
Figure 4:
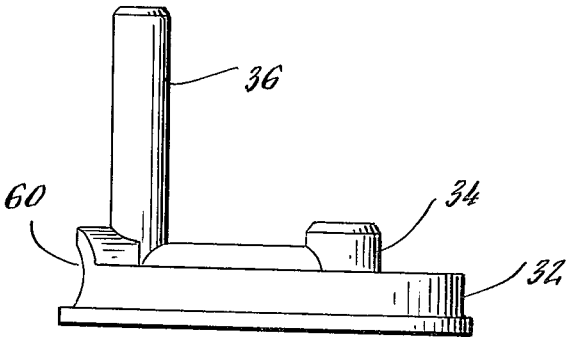
FIG. 4 is a side elevational view of a molded base element forming part of the device.

Referring more particularly to FIG. 3, casing 22 is typically formed of molded plastic to provide a generally cylindrical structure open at its lower end 28 and having an upper end wall 30 (see FIGS. 1 and 2) partially closing that end of the casing. As here illustrated, casing 22 is of roughly eliptical cross-section since the receiver 24 and dispenser 26 are slightly different in diameter.

The bottom or open end 28 of receiver 22 is adapted to receive and retain a base 32, preferably again of molded plastic, which is fitted in open end 28 and forms a closure for that end of the casing.

Base 32 is formed with a pair of pedestals 34, 36 which project upwardly within casing 22 in side-by-side relation. Pedestal 34 has a central or axial passage 38, and pedastal 36 likewise has an axial passage 40, both of these passages being in communication with a transverse passage 42 at spaced points along the latter.

Pedestal 34 is provided with a socket 44 in its upper end which communicates internally with passages 38 and 42. Socket 44 is adapted to receive and make a fluid tight coupling with the tubular valve stem 46 of typical aerosol dispenser 26 so that when fluid is discharged from dispenser 26, by pressing downwardly on its exposed upper end, the fluid charge is caused to travel by way of passages 38 and 42 to passage 40 of the other pedestal 36 and thus into receiver 24.

A hollow injection needle 48 is secured, point upwardly, in passage 40 of pedestal 36. The lower end of needle 48 communicates with passage 40 to allow fluid to enter the needle and to be discharged through ports 50 provided in spaced relation along needle 48.

Receiver 24 is superimposed on pedestal 36, an aperture 52 being formed in the closed lower end of the receiver to permit the needle to pass freely upwardly substantially centrally of the receiver.

To give access to receiver 24 and dispenser 26, the upper end wall 30 of casing 22 is apertured at 52, 54 to provide access openings which are axially aligned, respectively, with pedestals 34 and 36.

A restricter plug 56 is removably received in transverse passage 42 of base 32. Plug 56 has an enlarged head 58 which makes a fluid tight fit in the open end 60 of passage 42 in order to form a closure at that end of the passage. Plug 56 also has a stem 62 whose diameter is essentially the same as that of passage 42. Stem 62, however, has a flattened axially extending face 64 providing a segment-shaped clearance between the plug and the wall of passage 42 which thus forms a restriction in the passage between pedestals 34 and 36. The degree of restriction can be easily controlled in manufacture of the device by the amount of flattening of the stem in order to provide and desired degree of restriction. This is easily modified in manufacture to adapt the treatment device for different rates of application of the treatment fluid. In general it is preferred to control the total amount of treatment fluid by employing a suitably selected conventional aerosol metering valve in the aerosol dispenser, such as that shown in U.S. Pat. Nos. 3,185,356 or 2,932,432, each of these is designed to dispense a predetermined measured amount of fluid product on each actuation of the dispensing valve.

Figure 8:
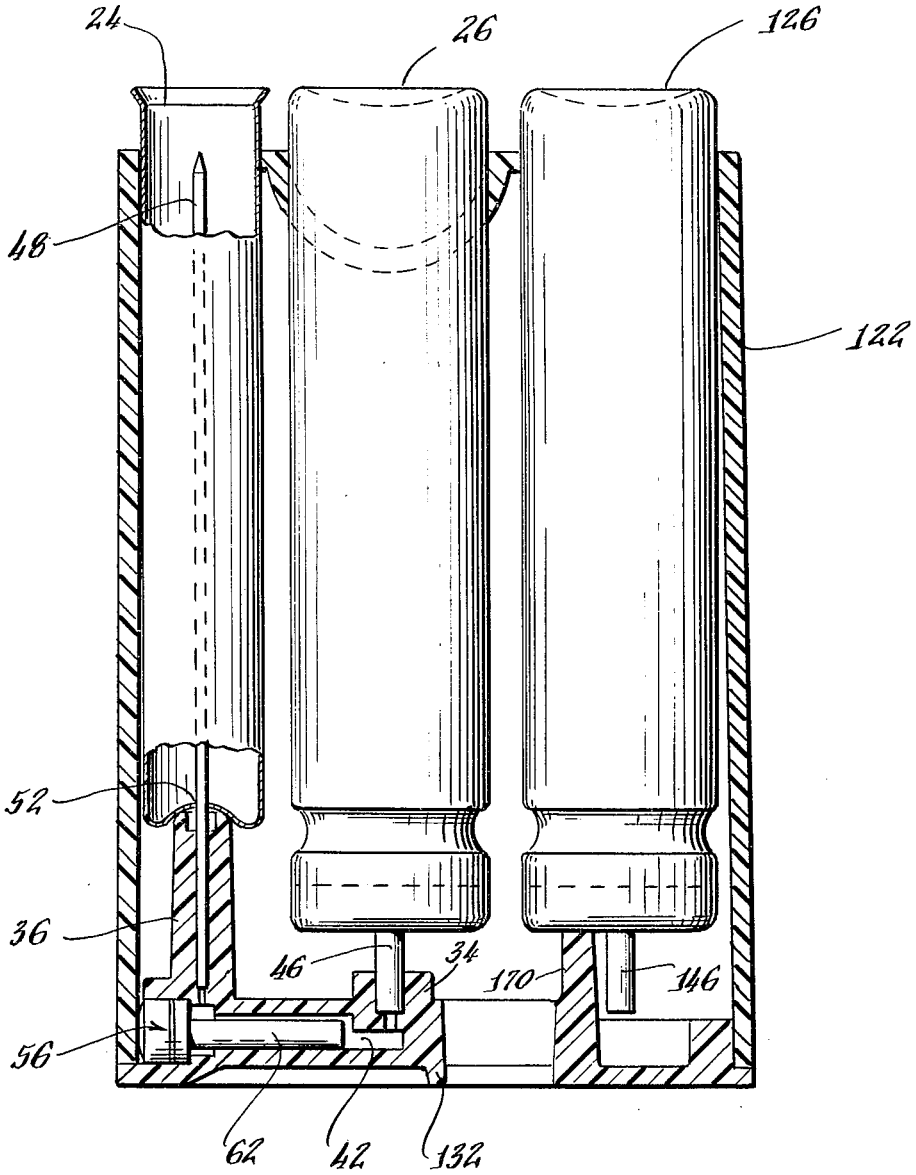
FIG. 8 is a side view in cross section of a modified form of device.

The modified device illustrated in FIG. 8 is essentially identical to that described above except that provision is made for incorporating a spare aerosol dispenser within the casing. In this instance casing 122 is elliptically elongated to accommodate the extra dispenser 126 alongside the active dispenser 26. Dispenser 126 is also supported in inverted position in the casing but in this case the ferrule of the valve rests on a peg 170 formed in base 132 so as to space valve stem 146 out of contact with the base, and thus prevent actuation of the valve. The upper end wall of casing 122 is provided with an additional access opening 152 through which dispenser 126 is inserted to place it in the storage position illustrated. When the active dispenser 26 is exhausted, it is withdrawn and replaced by the spare 126. In all other respects the modified device of FIG. 8 corresponds to that of FIGS. 1 to 3 in mechanical structure and operation.

Although specific embodiments of the present invention have been described above in detail, it is to be understood that this is for purposes of illustration and that other modifications may be made by those skilled in the art for purposes of adapting the invention to particular applications.

What is claimed is:

1. A device for treating a consumer unit of tobacco, comprising a generally cylindrical casing open at its lower end and having an end wall partially closing its upper end, said casing having a size and shape adequate to receive in side-by-side relation a valved tubular aerosol dispenser and a tubular receiver for a consumer unit of tobacco;

a molded plastic base received in the open end of said casing and providing a closure for the lower end of said casing;

said base having a pair of parallel passages directed axially of said casing and being in spaced relation to each other, and a transverse passage intersecting said spaced parallel passages and providing communication between them within said base;

said transverse passage being closed at one end and having a restricter plug removably received in the other end said plug extending axially into said transverse passage to partially restrict communication between said parallel passages;

a first of said parallel passages terminating at its upper end in an upwardly opening socket and being adapted and arranged for coupling thereto in fluid tight manner of a valve stem of a conventional axially operable valve of an aerosol dispenser, and said casing having a receiving aperture at its closed end in axial alignment with said socket for insertion of an aerosol dispenser into coupling engagement with said socket;

said other of said parallel passages having mounted therein a hollow injection needled projecting axially outwardly therefrom, said needle making communication internally with said other passage and thus with said transverse passage and first passage of said base;

a receiver for a consumer unit of tobacco, said receiver having an open upper end and a bottom wall at its other end, said receiver being positioned on said base and having an aperture in its bottom wall to accept the passage therethrough of said injection needle; and a second aperture in said end wall of said casing providing an access opening for the open end of said tubular receiver.

2. A device for treating a consumer unit of tobacco as defined in claim 1, wherein said base is formed with a pair of pedestals projecting upwardly within said casing in side-by-side relation, each of said pedestals having one of said parallel passages disposed therein;

said aerosol valve stem coupling socket being formed in a first of said pedestals and the upper end of said other pedesal constituting a seat for abutment of the bottom wall of said receiver.

3. A device for treating a consumer unit of tobacco as defined in claim 1, wherein said casing is formed in a size and shape adequate to receive a second valved tubular aerosol dispenser adjacent the first such dispenser, and wherein said device has a further receiving aperture in the closed end of said casing for the insertion of said extra aerosol dispenser, said base having a lug projecting upwardly for abutment with said dispenser to prevent contact of the valve stem against the base.

* * * * *